US011525227B2

(12) United States Patent
Garland

(10) Patent No.: US 11,525,227 B2
(45) Date of Patent: Dec. 13, 2022

(54) WASTE BAG DISPENSING AND STORING ASSEMBLY

(71) Applicant: Reki Garland, Smyrna, GA (US)

(72) Inventor: Reki Garland, Smyrna, GA (US)

( * ) Notice: Subject to any disclaimer, the term of this patent is extended or adjusted under 35 U.S.C. 154(b) by 899 days.

(21) Appl. No.: 16/387,622

(22) Filed: Apr. 18, 2019

(65) Prior Publication Data

US 2020/0332485 A1 Oct. 22, 2020

(51) Int. Cl.
*A45F 3/02* (2006.01)
*E01H 1/12* (2006.01)
*A45F 5/02* (2006.01)

(52) U.S. Cl.
CPC ..... *E01H 1/1206* (2013.01); *A45F 3/02* (2013.01); *A45F 5/021* (2013.01); *E01H 2001/1286* (2013.01)

(58) Field of Classification Search
CPC ..... A45F 5/021; A45F 3/02; E01H 1/1206; E01H 2011/1286; B65D 83/08; B65D 83/0805; B65D 83/0888; A47K 10/421; A47K 10/46
USPC ..... 206/233
See application file for complete search history.

(56) References Cited

U.S. PATENT DOCUMENTS 5,713,616 A * 2/1998 Knudson ..... E01H 1/1206 294/1.3
6,164,442 A * 12/2000 Stravitz ..... A45C 3/02 221/45
6,199,737 B1 3/2001 Ringelstetter
D442,754 S 5/2001 Gregoire
6,244,486 B1 * 6/2001 Holland ..... A45F 5/021 224/684
6,314,917 B1 11/2001 Ryan
D453,067 S 1/2002 Cody
6,401,993 B1 * 6/2002 Andrino ..... A45F 5/00 D3/229
7,073,462 B1 * 7/2006 Layman ..... A01K 27/008 119/867
7,367,286 B2 5/2008 Beaupre
9,078,417 B1 * 7/2015 Lees ..... A01K 27/008
9,192,144 B2 11/2015 Burke
2005/0263087 A1 12/2005 Livingston, III
2008/0163822 A1 1/2008 Faulkner
2011/0089204 A1 * 4/2011 Escalante ..... A45F 5/00 224/148.3
2011/0132952 A1 * 6/2011 Peterson-Malesci ..... A45F 5/02 224/660
2012/0234251 A1 9/2012 Harlan
2012/0286003 A1 * 11/2012 Shadday ..... E01H 1/1206 206/229

(Continued)

*Primary Examiner* — Scott T McNurlen

(57) ABSTRACT

A waste bag dispensing and storing assembly for use while walking a pet includes a shell that defines an interior space. The shell has a top that is open. The top is configured to insert a used pet waste bag into the interior space. A lid is hingedly coupled to the shell proximate to the top. The lid is configured to selectively couple to the shell to close the top. A hole is positioned in the lid. The hole is configured to position an end bag of a roll of bags that is positioned in the interior space so that the end bag protrudes from the shell. The end bag is configured to be grasped in digits of a hand of a user to extract the end bag concurrently with positioning of an adjacent bag in the hole.

8 Claims, 12 Drawing Sheets

(56) References Cited

U.S. PATENT DOCUMENTS

| | | | | |
|---|---|---|---|---|
| 2016/0135432 | A1* | 5/2016 | Cox | A01K 27/008 119/795 |
| 2017/0233170 | A1* | 8/2017 | Badurina | B65F 1/02 242/557 |
| 2019/0075898 | A1* | 3/2019 | Friedgood | A45C 13/005 |
| 2019/0261765 | A1* | 8/2019 | Alonzo | A45C 13/10 |

* cited by examiner

WASTE BAG DISPENSING AND STORING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to dispensing and storing assemblies and more particularly pertains to a new dispensing and storing assembly for use while walking a pet.

BRIEF SUMMARY OF THE INVENTION

An embodiment of the disclosure meets the needs presented above by generally comprising a shell that defines an interior space. The shell has a top that is open. The top is configured to insert a used pet waste bag into the interior space. A lid is hingedly coupled to the shell proximate to the top. The lid is configured to selectively couple to the shell to close the top. A hole is positioned in the lid. The hole is configured to position an end bag of a roll of bags that is positioned in the interior space so that the end bag protrudes from the shell. The end bag is configured to be grasped in digits of a hand of a user to extract the end bag concurrently with positioning of an adjacent bag in the hole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
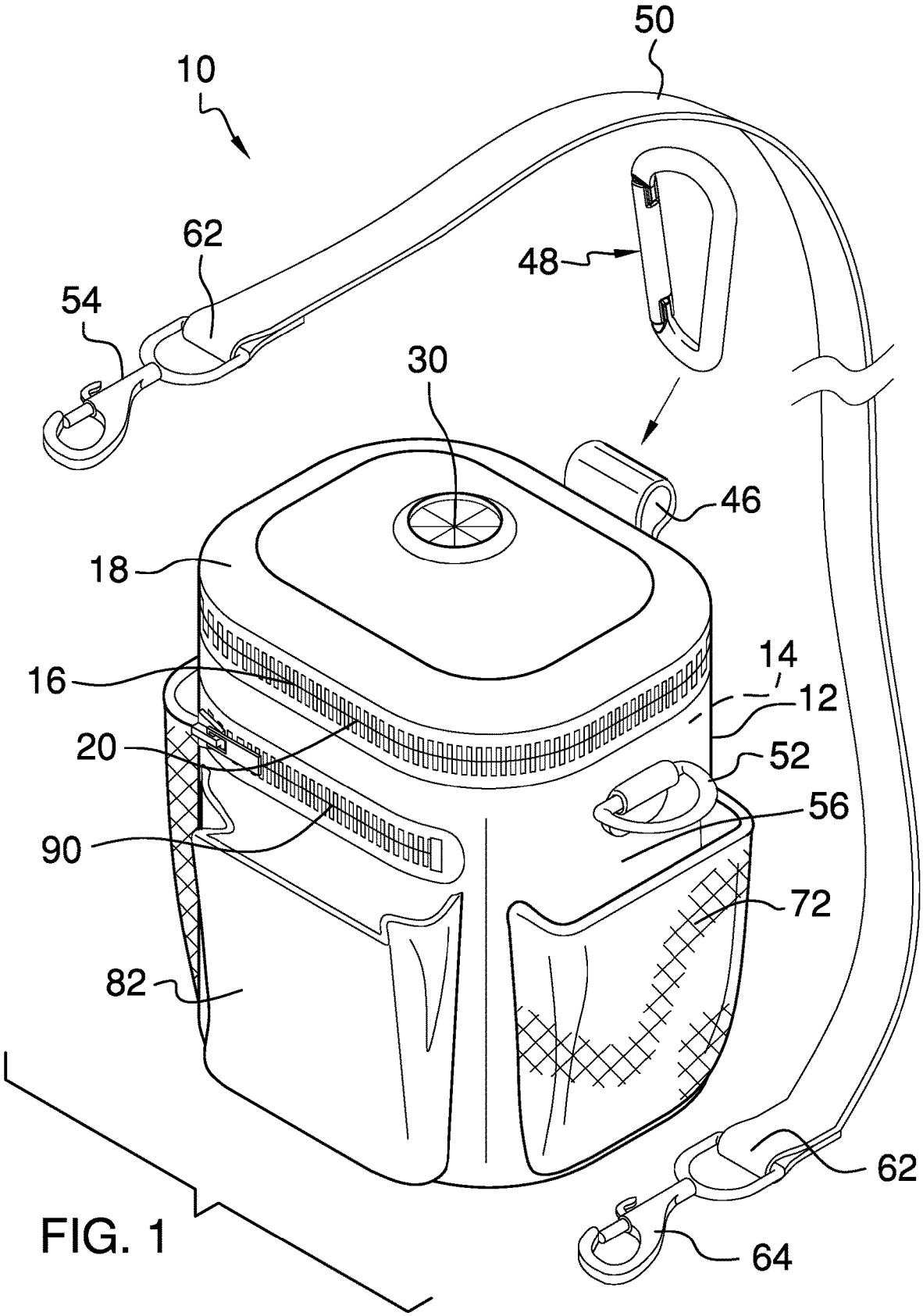
FIG. 1 is an isometric perspective view of a waste bag dispensing and storing assembly according to an embodiment of the disclosure.

With reference now to the drawings, and in particular to FIGS. 1 through 12 thereof, a new dispensing and storing assembly embodying the principles and concepts of an embodiment of the disclosure and generally designated by the reference numeral 10 will be described.

As best illustrated in FIGS. 1 through 12, the waste bag dispensing and storing assembly 10 generally comprises a shell 12 that defines an interior space 14. The shell 12 has a top 16 that is open. The top 16 is configured to insert a used pet waste bag into the interior space 14. The shell 12 may be scented to mask odors from the pet waste.

Figure 5:
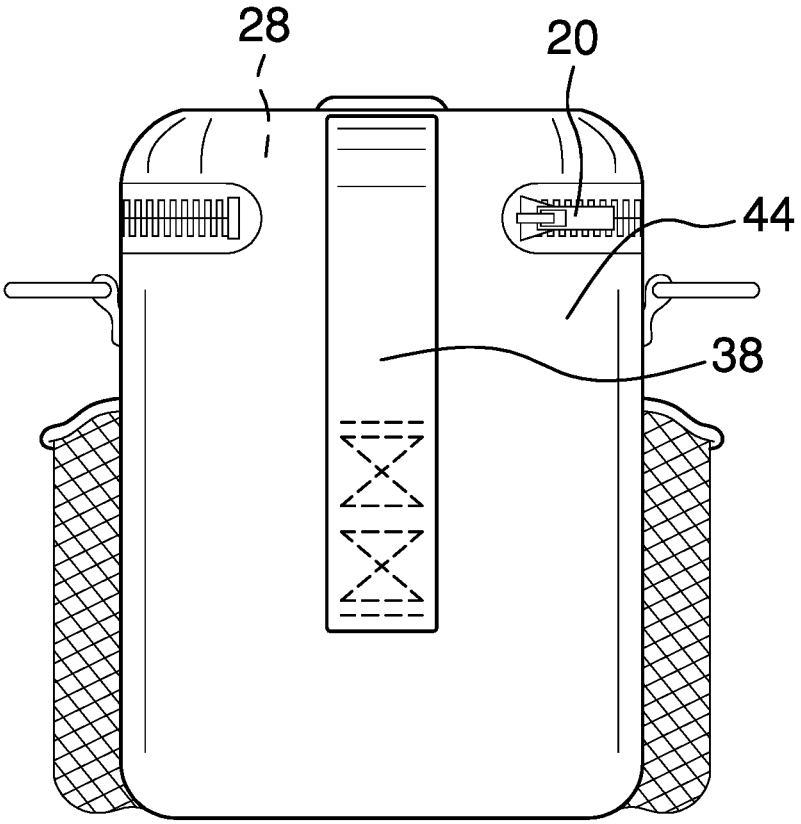
FIG. 5 is a back view of an embodiment of the disclosure.

A lid 18 is hingedly coupled to the shell 12 proximate to the top 16, as shown in FIG. 5. The lid 18 is configured to selectively couple to the shell 12 to close the top 16. A lid zipper 20 is coupled to and extends between the lid 18 and the shell 12. The lid zipper 20 is positioned to selectively couple the lid 18 to the shell 12 to close the top 16.

Figure 7:
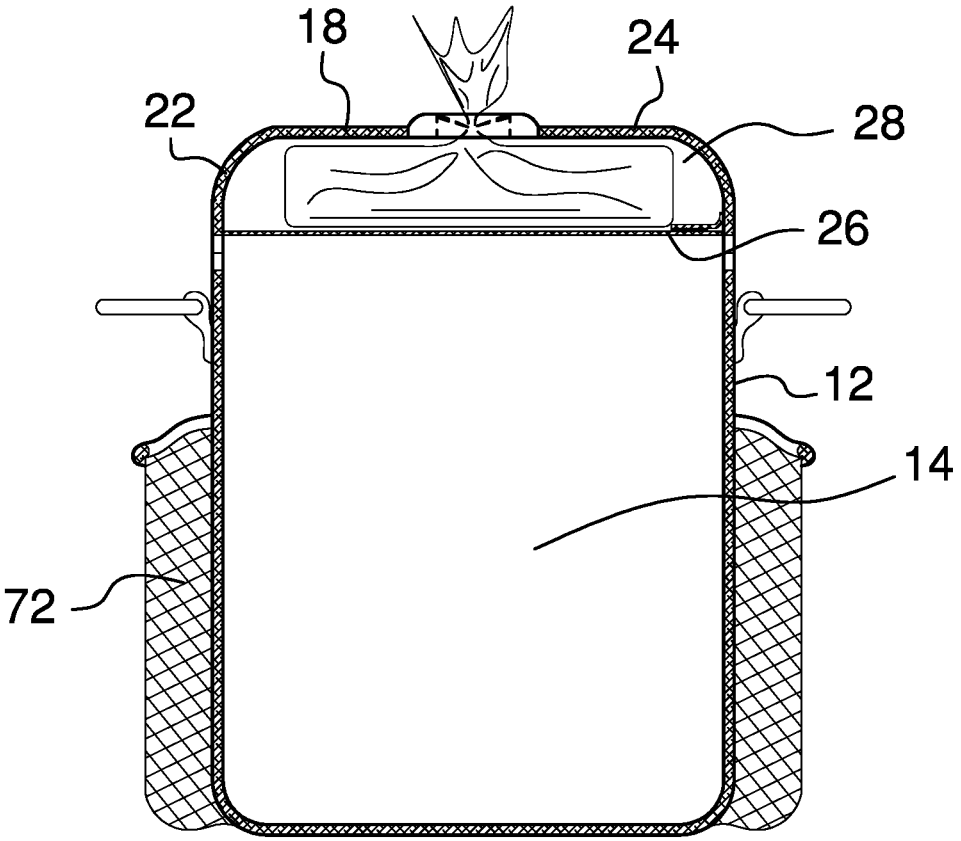
FIG. 7 is a cross-sectional view of an embodiment of the disclosure.

The lid 18 comprises a wall panel 22 that extends between an upper panel 24 and a lower panel 26 so that the lid 18 defines an internal space 28, as shown in FIG. 7. A hole 30 is positioned in the lid 18. The hole 30 is configured to position an end bag of a roll of bags that is positioned in the interior space 14 so that the end bag protrudes from the shell 12. The end bag is configured to be grasped in digits of a hand of a user to extract the end bag concurrently with positioning of an adjacent bag in the hole 30. The hole 30 is positioned in the upper panel 24 of the lid 18. A section 102 of a circumference 104 of the lower panel 26 is removably couplable to the wall panel 22 to define an opening 106. The opening 106 is configured for the user to insert the roll of bags into the internal space 28.

Figure 13:
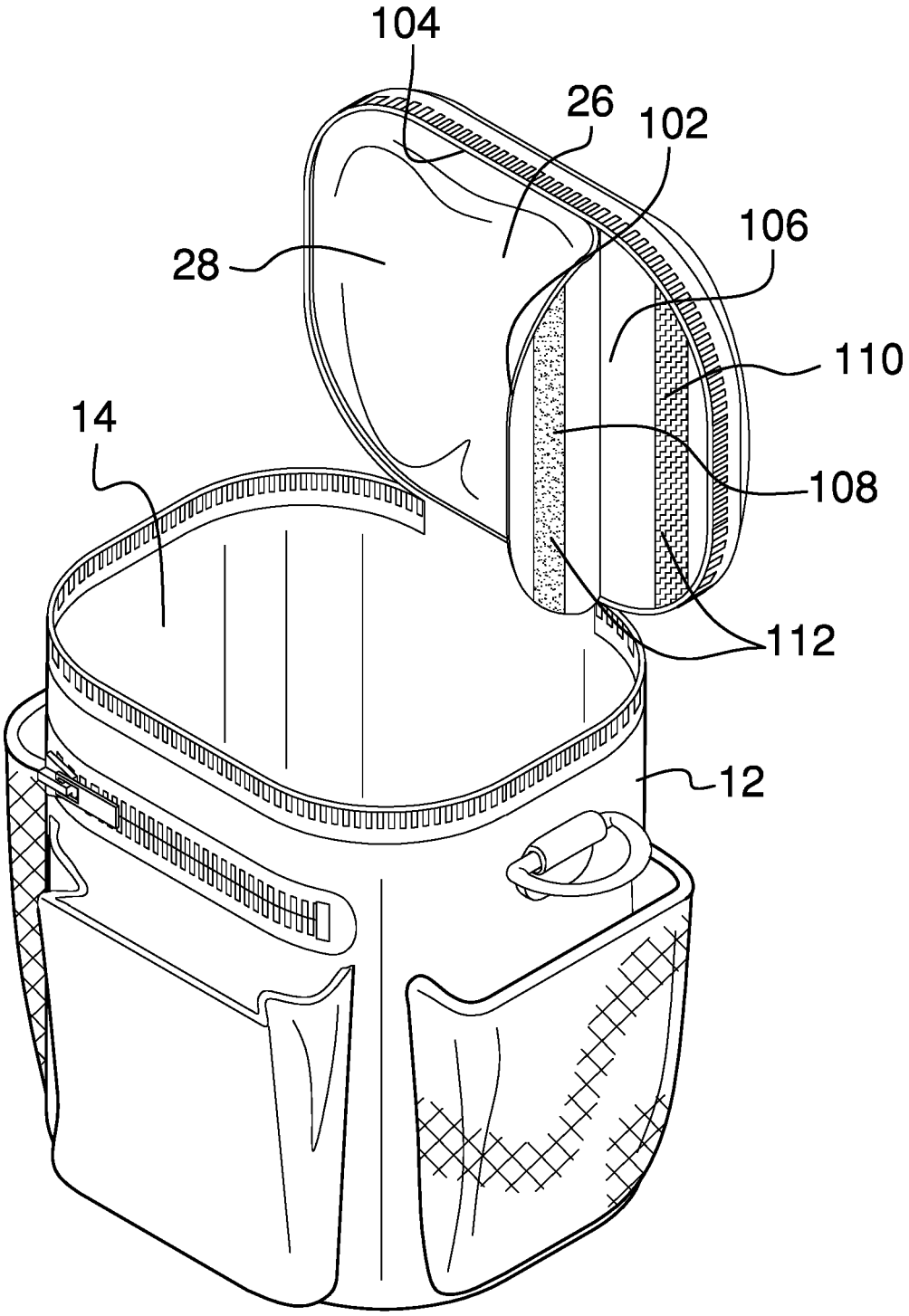
FIG. 13 is top open view of an embodiment of the disclosure.

A first fastener 108 is coupled to the lower panel 26 proximate to the opening 106. A second fastener 110 is coupled to the wall panel 22. The second fastener 110 is complementary to the first fastener 108 so that the second fastener 110 is positioned to selectively couple to the first fastener 108 to close the opening 106. The second fastener 110 and the first fastener 108 comprise a hook and loop fastener 112, as shown in FIG. 13. It also is anticipated that the second fastener 110 and the first fastener 108 comprise a plurality of snaps, a zipper, or a string closure (not shown).

Figure 3:
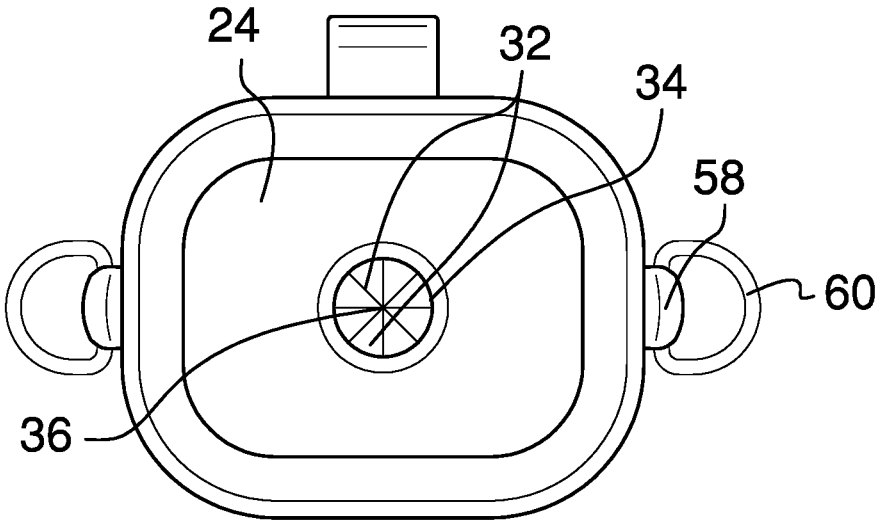
FIG. 3 is a top view of an embodiment of the disclosure.

A plurality of tabs 32 is coupled to and extends from a perimeter 34 of the hole 30 toward a center 36 of the hole 30, as shown in FIG. 3. The tabs 32 are resilient so that the tabs 32 are configured to slidably couple to the bag that is positioned in the hole 30. The tabs 32 are positioned to substantially close the hole 30.

Figure 2:
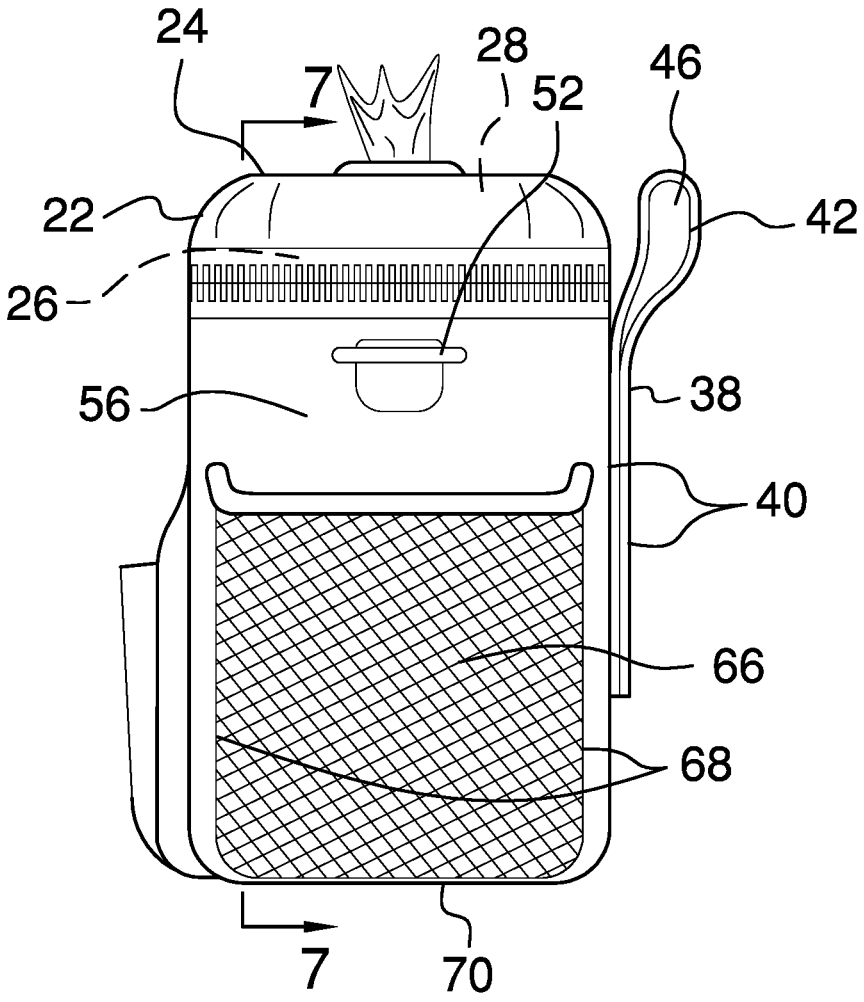
FIG. 2 is a side view of an embodiment of the disclosure.

The assembly 10 comprises a strip 38 that has opposing end segments 40 and a medial segment 42. The opposing end segments 38 are overlaid and are coupled to a back 44 of the shell 12 so that the medial segment 42 defines a loop 46, as shown in FIG. 2. The loop 46 is positioned proximate to the top 16 of the shell 12. The loop 46 is configured to insert a belt that is coupled to the user to couple the shell 12 to the user.

Figure 8:
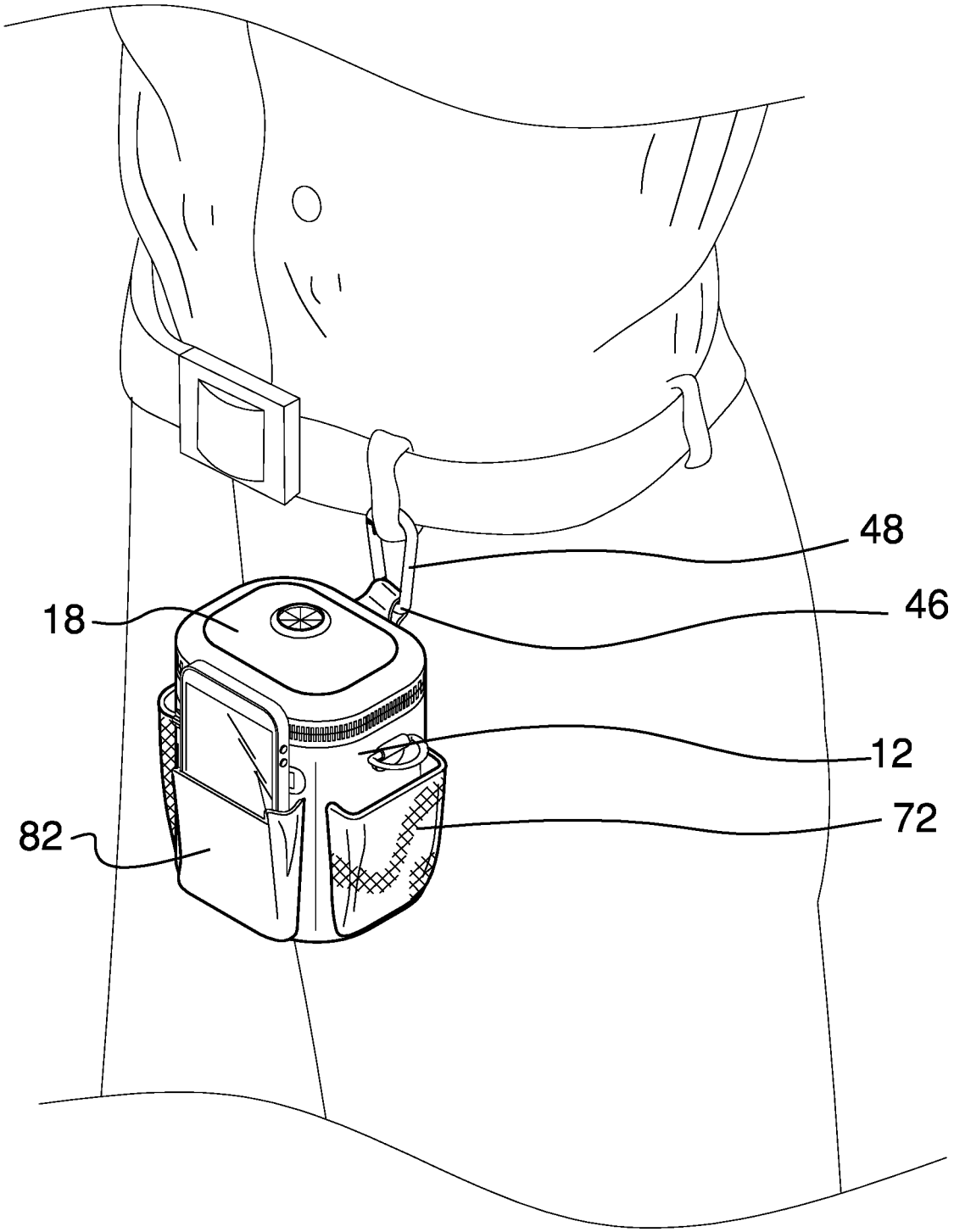
FIG. 8 is an in-use view of an embodiment of the disclosure.
Figure 9:
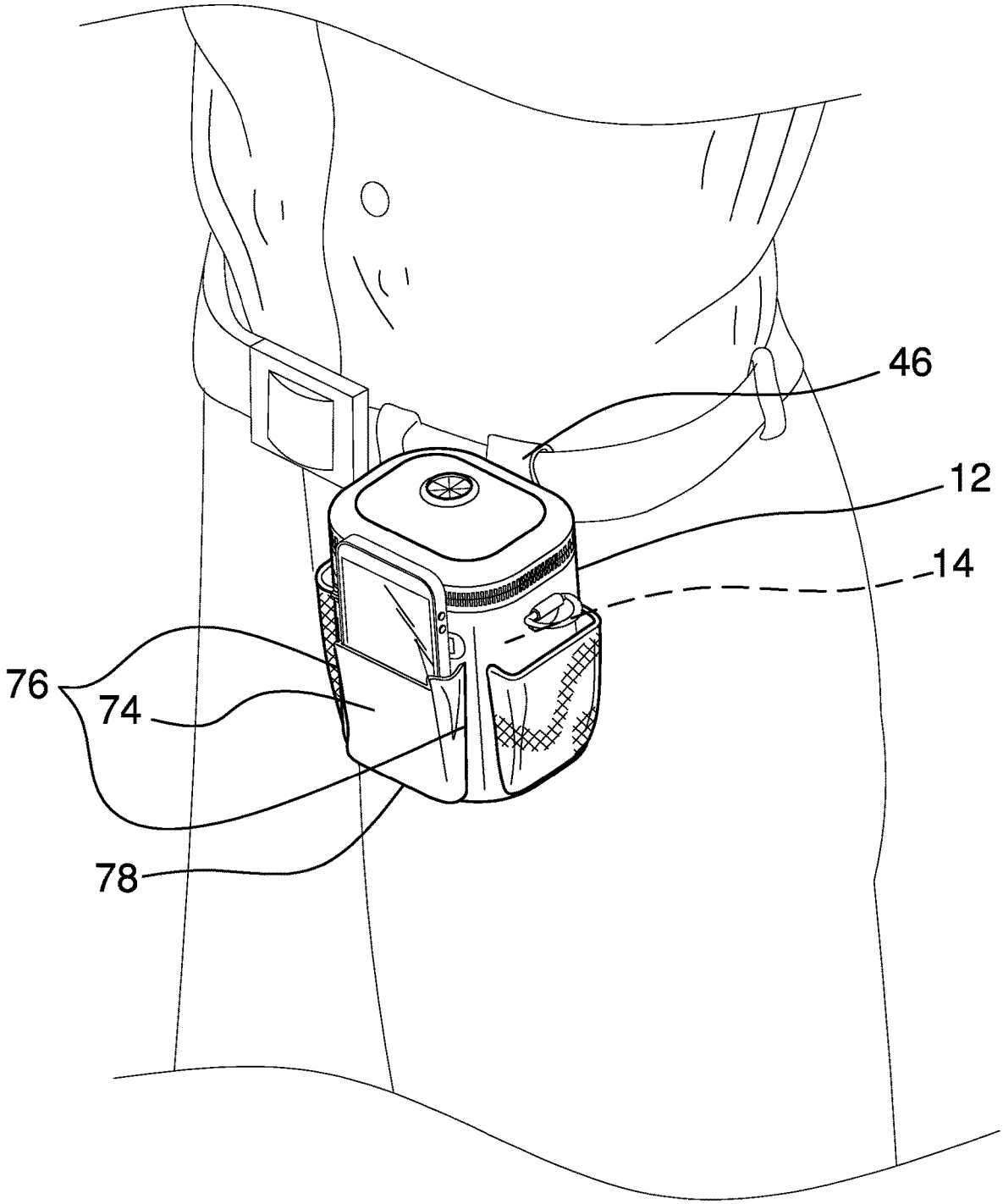
FIG. 9 is an in-use view of an embodiment of the disclosure.

The assembly 10 also comprises a carabiner 48 that is selectively positionable through the loop 46. The carabiner 48 is configured to couple to a beltloop of pants that are coupled to the user to couple the shell 12 to the user, as shown in FIG. 8.

Figure 6:
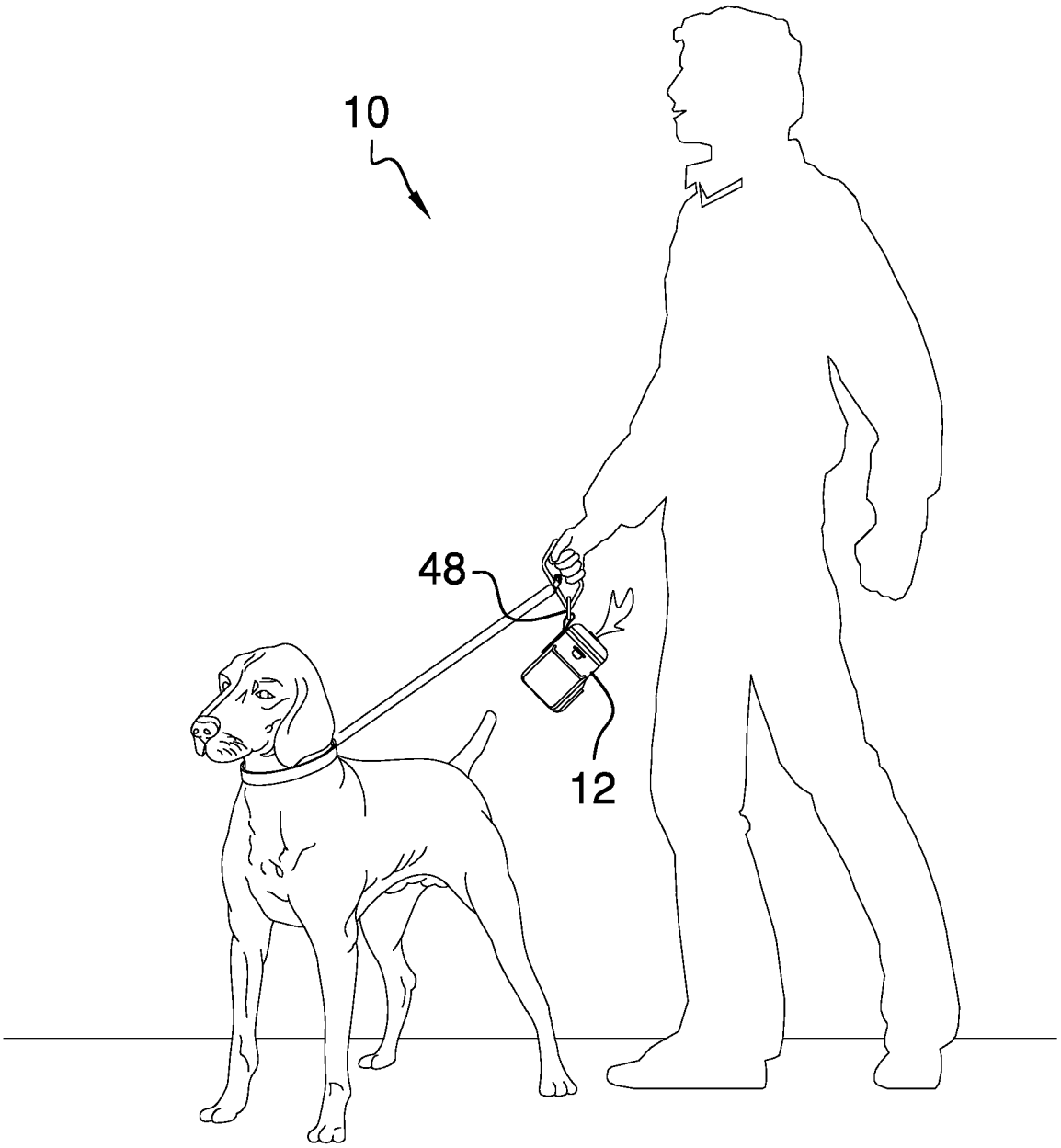
FIG. 6 is an in-use view of an embodiment of the disclosure.

The assembly 10 also comprises a strap 50, a pair of first couplers 52, and a pair of second couplers 54. Each first coupler 52 is hingedly coupled to a respective opposing side 56 of the shell 12 proximate to the top 16. Each first coupler 52 comprises a sleeve 58 and a ring 60. The sleeve 58 is coupled to the shell 12. The ring 60 is positioned through the sleeve 58 so that the ring 60 is hingedly coupled to the shell 12. The ring 60 is D-shaped. The ring 60 is positioned to selectively couple to the carabiner 48 so that the carabiner 48 is configured to couple to a leash to couple the shell 12 to the leash, as shown in FIG. 6.

Figure 10:
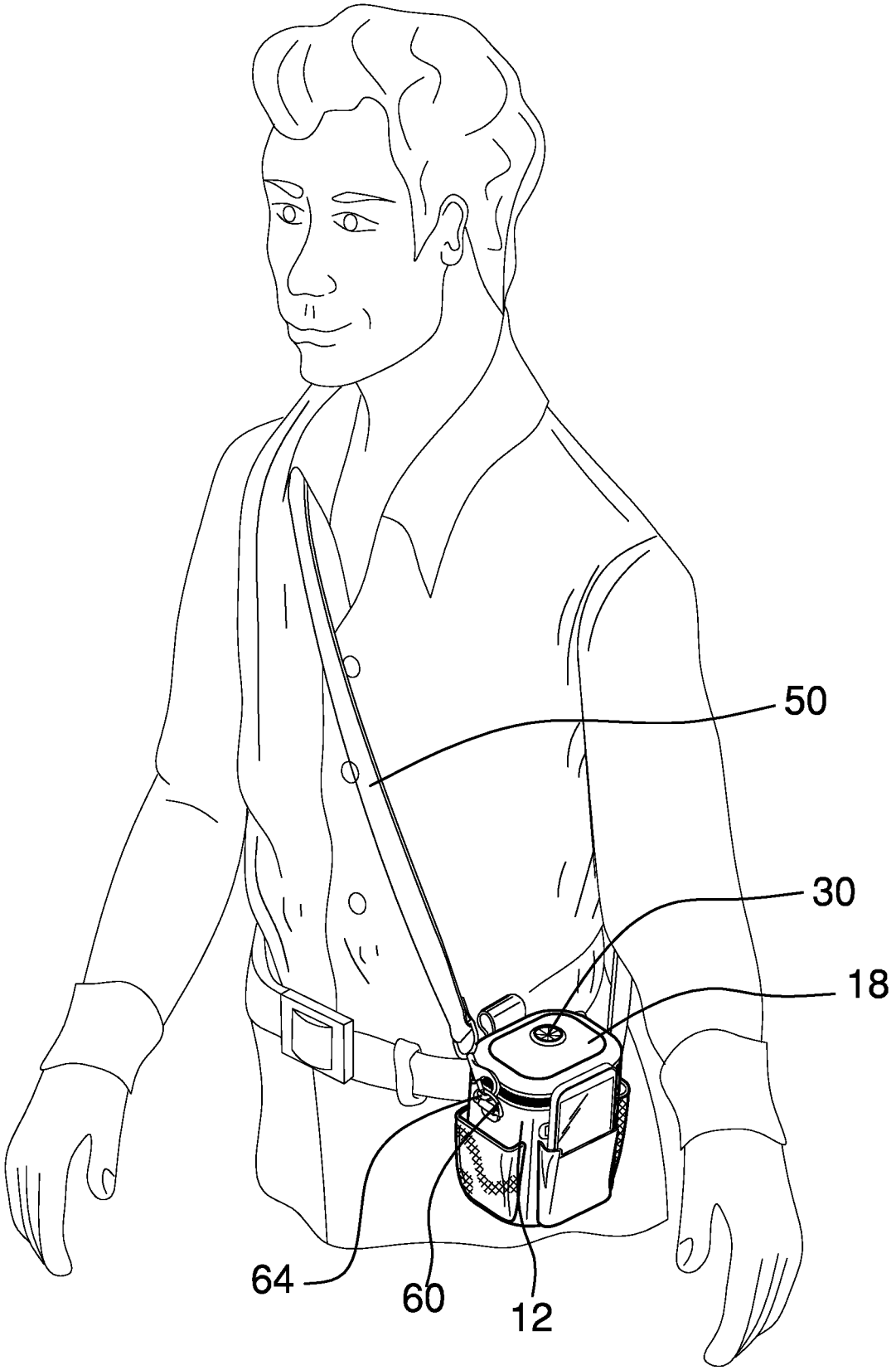
FIG. 10 is an in-use view of an embodiment of the disclosure.
Figure 11:
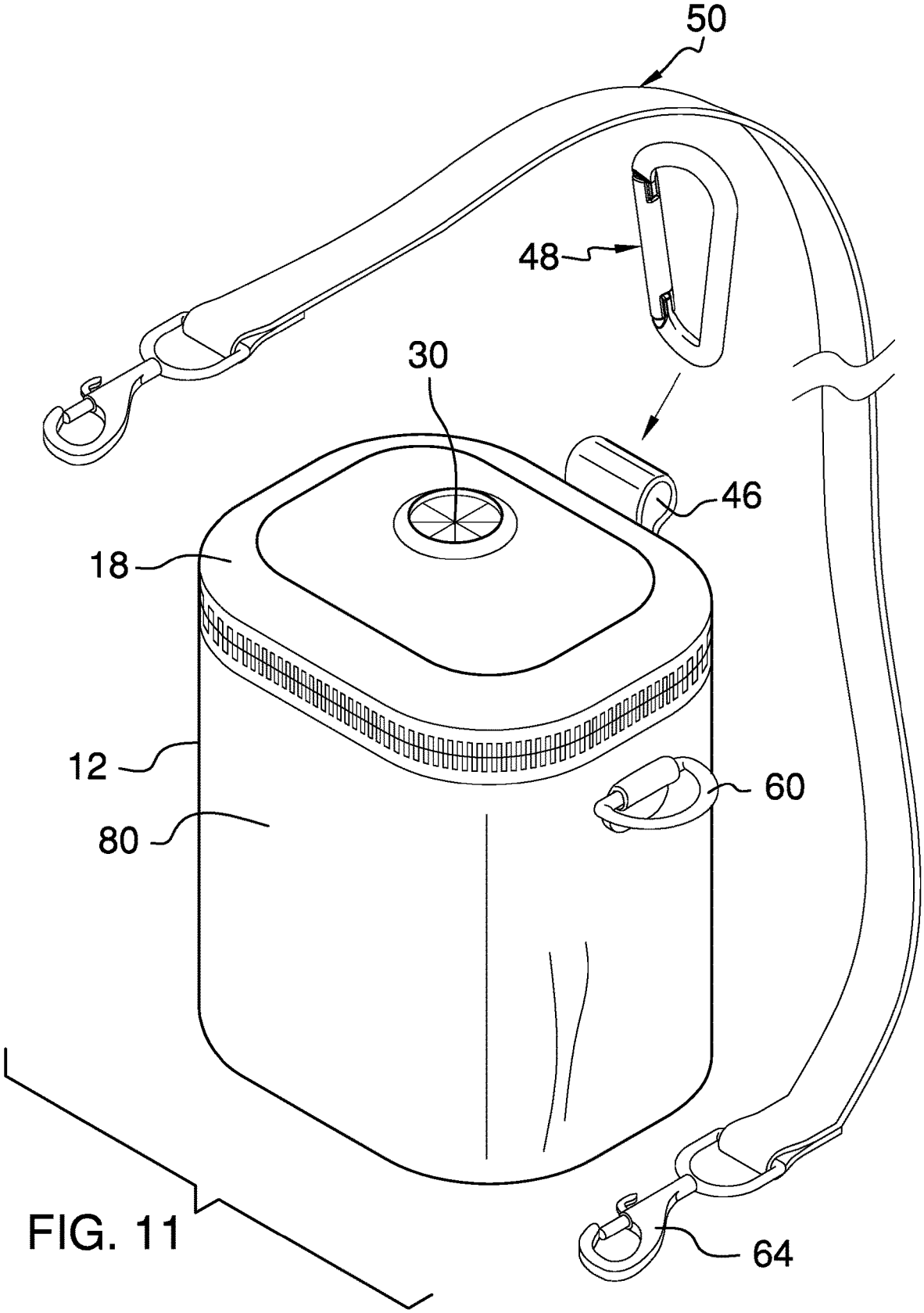
FIG. 11 is an isometric perspective view of an embodiment of the disclosure.

Each second coupler 54 is coupled to a respective opposing end 62 of the strap 50. The second couplers 54 are complementary to the first couplers 52. Each second coupler 54 comprises a snap hook 64. Each second coupler 54 is positioned to selectively couple to a respective first coupler 52 to couple the strap 50 to the shell 12. The strap 50 is configured to position over a shoulder of the user to couple the shell 12 to the user, as shown in FIG. 10.

Figure 4:
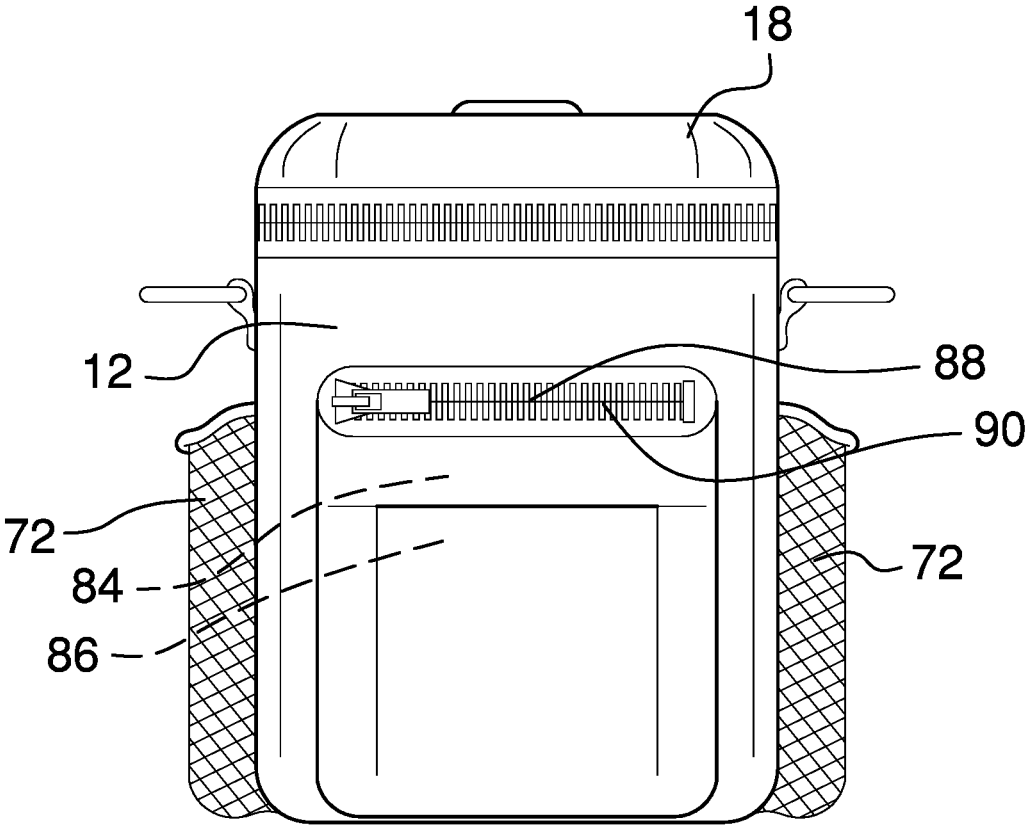
FIG. 4 is a front view of an embodiment of the disclosure.

In another embodiment of the invention, as shown in FIGS. 2 and 4, the assembly 10 comprises a pair of side panels 66. The side panels 66 are meshed. Each side panel 66 has opposing side edges 68 and a lower edge 70. The opposing side edges 68 and the lower edge 70 are coupled to a respective opposing side 56 of the shell 12 to defines a side pocket 72. The side pocket 72 is configured to position articles, such as dog treats.

In yet another embodiment of the invention, as shown in FIG. 4, the assembly 10 comprises a front panel 74. The front panel 74 has opposing edges 76 and a bottom edge 78. The opposing edges 76 and the bottom edge 78 are coupled to a front 80 of the shell 12 to define a front pocket 82. The front pocket 82 is configured to position items, such as a cell phone.

In still yet another embodiment of the invention, as shown in FIG. 4, the assembly 10 comprises an interior panel 84. The interior panel 84 is coupled to the front 80 of the shell 12 and is positioned in the interior space 14 to define an interior pocket 86. A slit 88 is positioned in the front 80 of the shell 12 and is positioned to allow access to the interior pocket 86. A pocket zipper 90 is coupled to the shell 12 and extends across the slit 88. The pocket zipper 90 is positioned to selectively close the slit 88.

Figure 12:
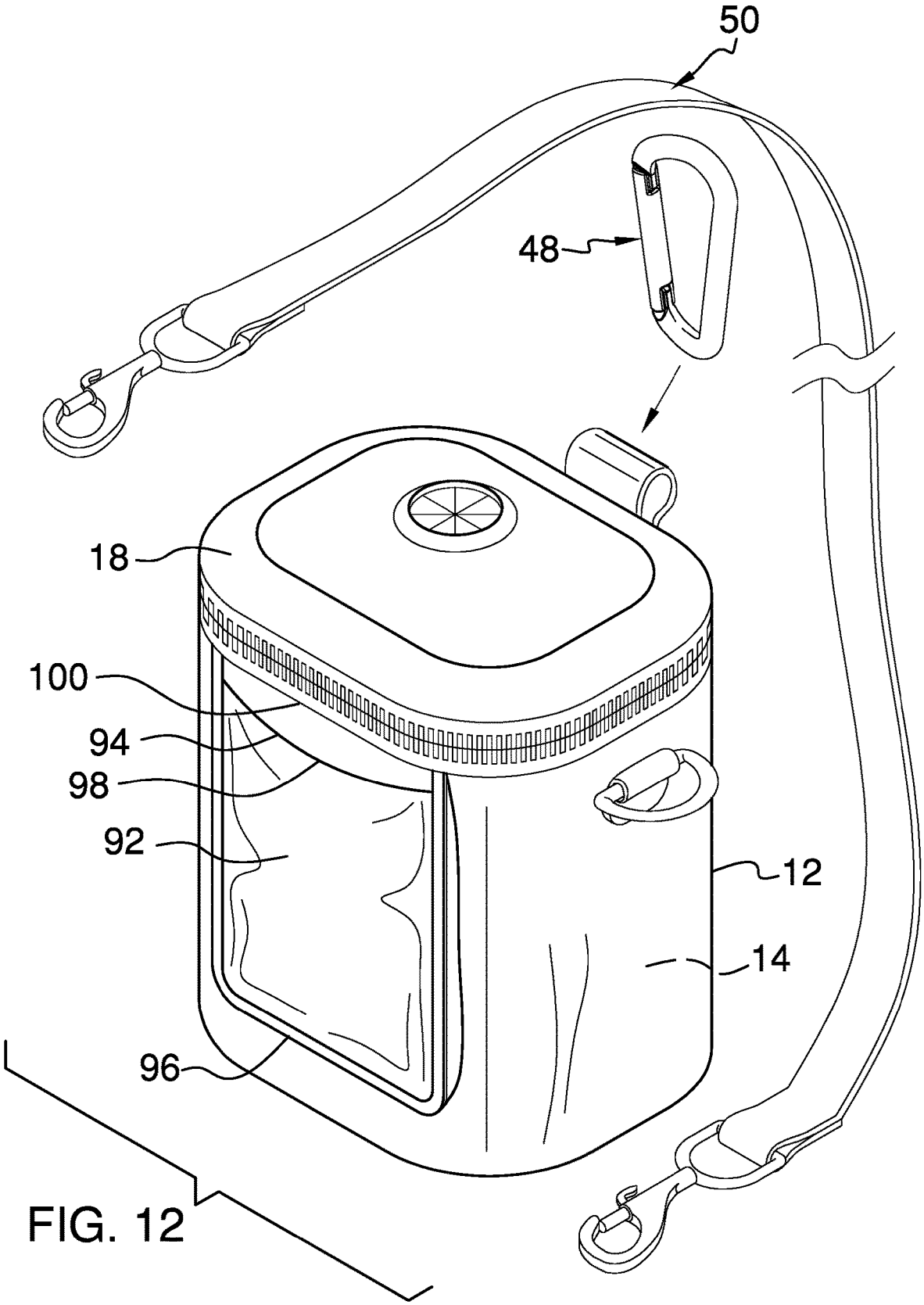
FIG. 12 is an isometric perspective view of an embodiment of the disclosure.

In still yet another embodiment of the invention, as shown in FIG. 12, the assembly 10 comprises a sleeve pocket 92. The sleeve pocket 92 has an upper end 94 that is open. The sleeve pocket 92 has a lower end 96 that is closed. The upper end 94 has a front rim 98 and a back rim 100. The back rim 100 is coupled to the front 80 of the shell 12 proximate to the top 16 so that the sleeve pocket 92 is hingedly coupled to the shell 12 so that the sleeve pocket 92 is floating type. The sleeve pocket 92 is pleated so that the sleeve pocket 92 is selectively expandable.

In use, the user couples the shell 12 to the user, the leash, or another object, using either the carabiner 48, the loop 46, or the strap 50. When required for waste collection the end bag is removed from the shell 12. After gathering the waste, the lid zipper 20 is used to open the lid 18, the waste bag is inserted into the interior space 14, and the lid zipper 20 is used to couple the lid 18 to the shell 12.

With respect to the above description then, it is to be realized that the optimum dimensional relationships for the parts of an embodiment enabled by the disclosure, to include variations in size, materials, shape, form, color, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A waste bag dispensing assembly comprising:

a shell defining an interior space, the shell having a top, the top being open wherein the top is configured for inserting a used pet waste bag into the interior space;

a lid hingedly coupled to the shell proximate to the top, the lid being configured for selectively coupling to the shell for closing the top, the lid comprising a wall panel extending between an upper panel and a lower panel such that the lid defines an internal space, a section of a circumference of the lower panel being removably couplable to the wall panel defining an opening wherein the opening is configured for inserting a roll of bags into the internal space; and a hole positioned in the upper panel of the lid wherein the hole is configured for positioning an end bag of the roll of bags positioned in the interior space such that the end bag protrudes from the shell wherein the end bag is configured for grasping in digits of a hand of a user for extracting the end bag concurrent with positioning an adjacent bag in the hole;

a lid zipper coupled to and extending between the lid and the shell wherein the lid zipper is positioned for selectively coupling the lid to the shell for closing the top;

a plurality of tabs coupled to and extending from a perimeter of the hole toward a center of the hole, the tabs being resilient wherein the tabs are configured for slidably coupling to the bag positioned in the hole and wherein the tabs are positioned for substantially closing the hole;

a strip having opposing end segments and a medial segment, the opposing end segments being overlaid and coupled to a back of the shell such that the medial segment defines a loop positioned proximate to the top of the shell wherein the loop is configured for inserting a belt coupled to the user for coupling the shell to the user;

a carabiner selectively positionable through the loop such that the carabiner is configured for coupling to a beltloop of pants coupled to the user for coupling the shell to the user;

a pair of side panels, each side panel having opposing side edges and a lower edge, the opposing side edges and the lower edge being coupled to a respective opposing side of the shell defining a side pocket wherein the side pocket is configured for positioning articles;

a front panel having opposing edges and a bottom edge, the opposing edges and the bottom edge being coupled to a front of the shell defining a front pocket wherein the front pocket is configured for positioning items;

an interior panel coupled to the front of the shell and positioned in the interior space defining an interior pocket;

a slit positioned in the front of the shell wherein the slit is positioned for accessing the interior pocket;

a pocket zipper coupled to the shell and extending across the slit wherein the pocket zipper is positioned for selectively closing the slit; and a sleeve pocket, the sleeve pocket being tubular, the sleeve pocket having an upper end, the upper end being open, the sleeve pocket having a lower end, the lower end being closed, the upper end having a front rim and a back rim, the back rim being coupled to the front of the shell proximate to the top wherein the sleeve pocket is hingedly coupled to the shell such that the sleeve pocket is floating type, the sleeve pocket being pleated such that the sleeve pocket is selectively expandable.

2. The assembly of claim 1, further comprising:

a first fastener coupled to the lower panel proximate to the opening;

a second fastener coupled to the wall panel, the second fastener being complementary to the first fastener such that the second fastener is positioned for selectively coupling to the first fastener for closing the opening.

3. The assembly of claim 2, further including the second fastener and the first fastener comprising a hook and loop fastener.

4. The assembly of claim 1, further comprising:

a pair of first couplers, each first coupler being hingedly coupled to a respective opposing side of the shell proximate to the top;

a strap; and a pair of second couplers, each second coupler being coupled to a respective opposing end of the strap, the second couplers being complementary to the first couplers wherein each second coupler is positioned for selectively coupling to a respective first coupler for coupling the strap to the shell such that the strap is configured for positioning over a shoulder of the user for coupling the shell to the user.

5. The assembly of claim 4, further comprising:

each first coupler comprising a sleeve and a ring, the sleeve being coupled to the shell, the ring being positioned through the sleeve such that the ring is hingedly coupled to the shell wherein the ring is positioned for selectively coupling to the carabiner such that the carabiner is configured for coupling to a leash for coupling the shell to the leash; and each second coupler comprising a snap hook.

6. The assembly of claim 5, further including the ring being D-shaped.

7. The assembly of claim 1, further including the side panels being meshed.

8. A waste bag dispensing assembly comprising:

a shell defining an interior space, the shell having a top, the top being open wherein the top is configured for inserting a used pet waste bag into the interior space;

a lid hingedly coupled to the shell proximate to the top, the lid being configured for selectively coupling to the shell for closing the top, the lid comprising a wall panel extending between an upper panel and a lower panel such that the lid defines an internal space, a section of a circumference of the lower panel being removably couplable to the wall panel defining an opening wherein the opening is configured for inserting the roll of bags into the internal space;

a first fastener coupled to the lower panel proximate to the opening;

a second fastener coupled to the wall panel, the second fastener being complementary to the first fastener such that the second fastener is positioned for selectively coupling to the first fastener for closing the opening, the second fastener and the first fastener comprising a hook and loop fastener;

a lid zipper coupled to and extending between the lid and the shell wherein the lid zipper is positioned for selectively coupling the lid to the shell for closing the top;

a hole positioned in the upper panel of the lid wherein the hole is configured for positioning an end bag of a roll of bags positioned in the interior space such that the end bag protrudes from the shell wherein the end bag is configured for grasping in digits of a hand of a user for extracting the end bag concurrent with positioning an adjacent bag in the hole;

a plurality of tabs coupled to and extending from a perimeter of the hole toward a center of the hole, the tabs being resilient wherein the tabs are configured for slidably coupling to the bag positioned in the hole and wherein the tabs are positioned for substantially closing the hole;

a strip having opposing end segments and a medial segment, the opposing end segments being overlaid and coupled to a back of the shell such that the medial segment defines a loop positioned proximate to the top of the shell wherein the loop is configured for inserting a belt coupled to the user for coupling the shell to the user;

a carabiner selectively positionable through the loop such that the carabiner is configured for coupling to a beltloop of pants coupled to the user for coupling the shell to the user;

a pair of first couplers, each first coupler being hingedly coupled to a respective opposing side of the shell proximate to the top, each first coupler comprising a sleeve and a ring, the sleeve being coupled to the shell, the ring being positioned through the sleeve such that the ring is hingedly coupled to the shell wherein the ring is positioned for selectively coupling to the carabiner such that the carabiner is configured for coupling to a leash for coupling the shell to the leash, the ring being D-shaped;

a strap;

a pair of second couplers, each second coupler being coupled to a respective opposing end of the strap, the second couplers being complementary to the first couplers wherein each second coupler is positioned for selectively coupling to a respective first coupler for coupling the strap to the shell such that the strap is configured for positioning over a shoulder of the user for coupling the shell to the user, each second coupler comprising a snap hook;

a pair of side panels, each side panel having opposing side edges and a lower edge, the opposing side edges and the lower edge being coupled to a respective opposing side of the shell defining a side pocket wherein the side pocket is configured for positioning articles, the side panels being meshed;

a front panel having opposing edges and a bottom edge, the opposing edges and the bottom edge being coupled to a front of the shell defining a front pocket wherein the front pocket is configured for positioning items;

an interior panel coupled to the front of the shell and positioned in the interior space defining an interior pocket;

a slit positioned in the front of the shell wherein the slit is positioned for accessing the interior pocket;

a pocket zipper coupled to the shell and extending across the slit wherein the pocket zipper is positioned for selectively closing the slit; and a sleeve pocket, the sleeve pocket being tubular, the sleeve pocket having an upper end, the upper end being open, the sleeve pocket having a lower end, the lower end being closed, the upper end having a front rim and a back rim, the back rim being coupled to the front of the shell proximate to the top wherein the sleeve pocket is hingedly coupled to the shell.

* * * * *